US005232464A

United States Patent [19]

Klezl

[11] Patent Number: 5,232,464

[45] Date of Patent: Aug. 3, 1993

[54] FUEL FOR INTERNAL COMBUSTION ENGINES AND USE OF METHYL FORMATE AS FUEL ADDITIVE

[75] Inventor: Peter Klezl, Vienna, Austria

[73] Assignee: OMV Aktiengesellschaft, Vienna, Austria

[21] Appl. No.: 838,927

[22] Filed: Feb. 21, 1992

[30] Foreign Application Priority Data

Feb. 26, 1991 [AT] Austria ..... A401/91

[51] Int. Cl.[5] ..... C10L 1/18

[52] U.S. Cl. ..... 44/388; 44/449; 44/446; 44/451

[58] Field of Search ..... 44/388, 449, 446, 451

[56] References Cited

U.S. PATENT DOCUMENTS 2,334,006 11/1943 Holm .
4,256,465 3/1981 Takezona et al. ..... 44/449
4,375,361 3/1983 Lyons et al. ..... 44/310
4,390,344 6/1983 Sweeney .

FOREIGN PATENT DOCUMENTS 0049995 4/1982 European Pat. Off. .
0227176 7/1987 European Pat. Off. .
2447345 4/1976 Fed. Rep. of Germany .
2809481 7/1979 Fed. Rep. of Germany .
835038 7/1983 South Africa .
1411947 10/1975 United Kingdom .

OTHER PUBLICATIONS

Austrian Office Action dated Sep. 12, 1991.
European Search Report Jun. 4, 1992.

*Primary Examiner*—Prince Willis, Jr.
*Assistant Examiner*—Alan D. Diamond
*Attorney, Agent, or Firm*—Sandler, Greenblum & Bernstein

[57] ABSTRACT

The fuel for internal combustion engines employing electrical fuel ignition and a carburetor and/or fuel injection, comprises a boiling fraction of 30° C. to 200° C., especially 30° C. to 180° C., containing hydrocarbons selected from the group consisting essentially of paraffinic, olefinic, naphthenic and aromatic hydrocarbons and mixtures thereof, and which is free of manganese, lead and iron. According to the invention, the fuel contains methyl formate in an amount in the range of 1.0 percent by volume to 50.0 percent by volume, if desired 1.0 percent by volume to 30.0 percent by volume, and preferably 3.5 percent by volume to 10.0 percent by volume of the fuel.

22 Claims, No Drawings

FUEL FOR INTERNAL COMBUSTION ENGINES AND USE OF METHYL FORMATE AS FUEL ADDITIVE

BACKGROUND OF THE INVENTION

1. Field of the Invention

The present invention relates to a new and improved fuel for internal combustion engines employing electrical fuel ignition and to the use of methyl formate as a fuel additive.

2. Discussion of the Background and Material Information

As is generally known in this technology, the efficiency of thermal engines increases the greater the temperature difference between the incoming medium and the outgoing medium. The consequence of this phenomenon in the case of internal combustion engines is that there must be simultaneously employed increasingly greater pressures in order to achieve an increased working or operating temperature. In the case of internal combustion engines with positively induced ignition of the fuel mixture this fuel mixture must not be self-igniting. As a measure of this capability there has been introduced the octane number. Depending upon the differently employed methods of determining such octane number, reference is made to the research octane number (RON), to the motor or engine octane number (MON), the street or road octane number (SON), and the front octane number (FON). Since the RON is determined both under lesser mechanical as well as thermal loads than the MON, a great many fuels have a lower RON than MON. However, the MON constitutes a value which more closely reflects practice since it is determined under more stringent conditions. In the case of the FON the procedure for determining the same entails taking a fraction from the fuel, which fraction distills over up to 100° C., and from such fraction there is then determined the RON. Therefore, the FON is a measure of the knock rating of the fuel constituents which boil at the start.

Since a difference is present, especially when there are added anti-knock agents, between the real behavior of the fuel in an engine and the determined values, such as MON, RON and FON, there are additionally performed road tests which are carried out with mass produced engines. In that case reference is made to the SON. These tests are of particular significance inasmuch as it has been found that, for instance, the addition of tetra ethyl lead during road tests has proven to be more effective than with the test engines which have been used for determining the RON or the MON or the FON. In this connection, reference is made to a so-called lead bonus.

With the employment of catalysts in catalytic converters for the further catalytic chemical conversion of the engine exhaust gases, as such has been initiated in the United States, it was necessary to develop knock-resistant, lead-free fuels, since lead acts as a catalyst poison and therefore would correspondingly impair the effectiveness of the catalysts of the catalytic converters.

Instead of using lead compounds there can be used, for example, also other iron or manganese compounds as anti-knock agents. These compounds exhibit high toxicity, and furthermore, oxides remain in the combustion compartment which, to the extent that no other additives are provided in the fuel, can lead, on the one hand, to premature wear of the pistons and cylinders of the internal combustion engine and, on the other hand, to a premature ignition of the fuel mixture by incandescent residues. This phenomenon is known in publications as "post dieseling". In the case of an engine which is exposed to increased loads, this phenomenon can even result in melting of the pistons.

Owing to the use of catalysts in catalytic converters it is necessary to provide lead-free fuels and since, furthermore, for health reasons attempts have been made to maintain lead emissions as low as possible, the lead content of fuels has been systematically lowered or even totally eliminated, and there are employed other anti-knock agents. Methyl tert.-butyl ether should be here mentioned as an anti-knock agent which has found particularly widespread use in more recent times. This compound has a boiling point of 55.3° C. and a density of 0.7458 g/cm$^3$ at 15° C. With the addition of methyl tert.-butyl ether (MTBE), depending upon the composition of the basic gasoline, there can be attained an RON between 115 and 135 and an MON between 98 and 120. The addition of MTBE is accomplished within the limits of 3.0 percent by volume and 15.0 percent by volume of the gasoline. What is disadvantageous with the addition of MTBE is that the increase of that measuring number which is significant for the normal operation of an engine, namely, the MON, is not effected to that desired extent as in the case of the RON.

Apart from the addition of anti-knock agents a large number of further substances are added to fuels in order to obtain a certain fuel property level. Therefore, fuel additives are known for avoiding fouling of the carburetor. Also, there are known additives for retarding fuel oxidation, in order to avoid the formation of resin-like tacky residues. Further additives are those which are intended to prevent the corrosion of the metals by the fuel. Other additives are those forming copper complexes in order to prevent oxidation of the fuel and also additives intended to prevent icing of the carburetor. Regarding the group of additives used to prevent carburetor icing, there are either employed surfactants or compounds which lower the freezing point of water. As to such multiplicity of additives there are mentioned in the literature amines, diamines, amides, ammonium salts of diesters of phosphoric acids, glycerine, alcohols, glycols, ketones, dimethylformamide and dimethylacetamide.

In German Published Patent Application No. 2,447,345, published Apr. 15, 1976, there have been disclosed synthetic fuel mixtures composed of methanol, formaldehyde dimethylacetal and formic acid methyl ester, which are intended to be used as synthetic fuel mixtures. In order to obtain an appropriate octane number, iron carbonyl and organic manganese compounds are provided as additives.

SUMMARY OF THE INVENTION

Therefore, with the foregoing in mind, it is a primary object of the present invention to provide an improved fuel for internal combustion engines employing electrical fuel ignition which exhibits the smallest possible difference between the RON-value and the MON-value.

Another important object of the present invention aims at devising an improved fuel for engines which is compatible with catalysts such as are employed for the chemical post-treatment of engine exhaust gases and which appreciably increases the ageing-resistance of the fuel.

Yet another significant object of the present invention is concerned with reducing the cloud point of gasolines and reducing the icing danger both at carburetor engines and also fuel injection engines.

Still a further noteworthy object of the present invention relates to the use of methyl formate as a fuel additive.

DETAILED DESCRIPTION OF THE PREFERRED EMBODIMENTS

Now in order to implement these and still further objects of the present invention, which will become more readily apparent as the description proceeds, the fuel for internal combustion engines working with electrical fuel ignition employing a carburetor and/or fuel injection, with a boiling fraction of 30° C. to 200° C., especially from 30° C. to 180° C., containing paraffinic and/or olefinic and/or naphthenic and/or aromatic hydrocarbons, and which is free of manganese, lead and iron, as contemplated by the present development is manifested, among other things, essentially by the features that the fuel contains methyl formate in the range of 1.0 to 50.0 percent by volume, if desired, 1.0 to 30.0 percent by volume, and preferably 3.5 to 10.0 percent by volume of the fuel.

Methyl formate is a large-scale industrial chemical which fulfills all requirements placed upon a substance which is supposed to improve the octane number. The starting material is synthesis gas which is reacted in known manner with methanol and such through conventional carbonylation produces methyl formate (hereinafter sometimes briefly referred to as "MF").

A further advantage resides in the fact that this compound, like other oxygen-containing constituents (for example, furanes), does not have any negative effect upon the stability of the carburetor fuel (induction time, existent gum).

Also the toxicity has been extensively examined. There does not exist any carcinogenic action, the MAC value (maximum permissible working place concentration) is equal to the higher aromatics (ethyl benzene, xylene), and during animal tests has been found to even be less harmful than such; $LCL_o$-values, inhalation guinea pigs:

| | |
|---|---|
| Xylene mixture | 450 ppm. |
| Toluene | 1600 ppm. |
| MF | 10000 ppm. |

Methyl formate (MF) has a boiling point of 31.5° C., so that it also can be used in greater quantities as a constituent of gasoline. It was quite surprising that additives of methyl formate could replace, for example, the additives of other anti-knock agents, such as lead compounds, wherein apart from such property there is prevented the icing of carburetors and fuel injection devices, and even when present in smaller percentile amounts there can be prevented ageing due to oxygen present in the fuel. Notwithstanding the greater density of methyl formate in relation to MTBE, it is able to also increase the FON. It is not necessary to add organometallic compounds for increasing the knock number.

If the fuel possesses an additional content of methyl tert.-butyl ether, then also with such fuel by virtue of the addition of methyl formate there is attained an increase in the MON. It is particularly advantageous when the fuel contains a 1:1 ratio of methyl formate to methyl tert.-butyl ether.

If the fuel contains a mixture of methyl formate and methyl tert.-butyl ether in the range of 10.0 percent by volume to 60.0 percent by volume, especially 30.0 percent by volume to 50.0 percent by volume of the fuel, then there is obtained a fuel which contains a particularly high proportion of products which distill over up to 100° C., so that apart from the increase in the RON there is also obtained a particularly favorable acceleration behavior or characteristic of vehicles. A particularly significant increase in practice-related properties of the fuel, is then realized when this mixture is present in the fuel approximately in the 30.0 percent by volume to the 50.0 percent by volume range.

If the fuel additionally contains alcohols, especially methyl alcohol and/or ethyl alcohol, then in individual cases, if desired, there can be realized an additional increase in both the RON as well as also the MON, and at the same time there can be obtained an increased solubility of hydrophilic substances in the fuel, so that there can be attained a particularly trouble-free operation of the carburetor or also the fuel injection system. These properties have been especially obtained by virtue of the lower alcohols, such as methyl alcohol or ethyl alcohol, and furthermore, there is present a particularly good availability of these two chemicals.

If the fuel contains a mixture of methyl formate, methyl tert.-butyl ether and methyl alcohol, especially in the same volumetric quantities, in the 10.0 percent by volume to 60.0 range, then there is ensured disturbance-free operation even in the presence of difficult climatic conditions.

If this mixture is present in the range of 30.0 percent by volume to 50.0 percent by volume of the fuel, then there exist fuel mixtures which can be subjected to extreme conditions.

The present invention is also concerned with the method of using methyl formate as an octane number-increasing, especially MON-increasing additive for a manganese-, lead- and iron-free fuel for internal combustion engines having electrical ignition with a carburetor and/or fuel injection, with a boiling fraction of 30° C. to 200° C., especially from 30° C. to 180° C., containing paraffinic and/or olefinic and/or naphthenic and/or aromatic hydrocarbons, especially present in an amount in the range of 1.0 to 50.0 percent by volume, if desired, 1.0 percent by volume to 30.0 percent by volume, and preferably 3.5 percent by volume to 10.0 percent by volume of the total fuel solution.

Even though methyl formate has been previously known as a fuel constituent, it was only used because of its good properties as fuel due to its calorific value and as solubilizing agent. In addition to the methyl formate there were provided metallic compounds which increased the octane number. Although methyl formate possesses a lower RON than different other additives which increase the knock number, it has an identical RON and MON, whereby its suitability for practical application becomes particularly evident. Even in small volume amounts, such as, for example, 1.0 percent by volume to 3.5 percent by volume of the fuel, methyl formate is effective to increase the RON, and there can be particularly stressed, apart from this property, the property of reducing the cloud point of the fuel as well as the deposition of sediments from the fuel. Additionally, there is improved the starting behavior of fuel injection engines at low temperatures. With fuel injection at low temperatures the danger exists that the fuel, which expands after issuing from the injection nozzle during the fuel injection operation, causes icing of the injection nozzle, and apart from obturation of the injection opening there also can arise an asymmetrical shifting of the injection nozzle, so that the lengthwise orientation of the injected fuel jet can be appreciably altered, so that, for instance, oil films in the cold engine can be washed away from the cylinder wall by the disoriented fuel jet, resulting in irreversible premature engine wear.

In the following description the present invention will be further explained based upon the following examples.

EXAMPLE 1

Regular Gasoline

A boiling fraction of 30° C. to 180° C. of a petroleum base stock had a density 0.740 g/cm$^3$. After storage of the mixture at −22° C., turbidity occurred after 5 hours since the water or moisture content of 250 ppm at this temperature no longer could be kept in solution. After 3 days storage at room temperature there was observed sedimentation in the gasoline.

Using the same boiling fraction there was added methyl formate to form the fuel, the methyl formate being present in an amount of 2.0 percent by volume of the fuel, and there first could be noticed turbidity following storage for 5 hours at −60° C. After 3 days of storage at room temperature there did not occur any sedimentation.

EXAMPLE 2

Of the boiling fraction of Example 1, without additive, there were determined the RON and MON. These values are given in Appendix Table I.

EXAMPLE 3

Methyl formate was added to the boiling fraction of Example 2 to produce a fuel which contained 5.0 percent by volume methyl formate and there were determined the RON and MON. These values are given in Appendix Table I.

EXAMPLE 4

Methyl formate was added to the boiling fraction of Example 2 to produce a fuel which contained 10.0 percent by volume methyl formate. There were determined the RON and MON. These values are given in Appendix Table I.

EXAMPLE 5

Methyl formate was added to the boiling fraction of Example 2 to produce a fuel which contained 20.0 percent by volume methyl formate. There were determined the RON and MON. These values are given in Appendix Table I.

EXAMPLE 6

Methyl formate was added to the boiling fraction of Example 2 to produce a fuel which contained 30.0 percent by volume methyl formate. There were determined the RON and MON. These values are given in Appendix Table I.

EXAMPLE 7

Methyl formate was added to the boiling fraction of Example 2 to produce a fuel which contained 40.0 percent by volume methyl formate. There were determined the RON and MON. These values are given in Appendix Table I.

EXAMPLE 8

Methyl formate was added to the boiling fraction of Example 2 to produce a fuel which contained 50.0 percent by volume methyl formate. There were determined the RON and MON. These values are given in Appendix Table I.

EXAMPLE 9

There were determined the RON and MON of pure methyl formate. These values are given in Appendix Table I.

EXAMPLE 10

Methyl tert.-butyl ether was added to the boiling fraction of Example 2 to produce a fuel which contained 10.0 percent by volume methyl tert.-butyl ether. There were determined the RON and MON. These values are given in Appendix Table I.

EXAMPLE 11

Methyl tert.-butyl ether was added to the boiling fraction of Example 2 to produce a fuel which contained 20.0 percent by volume methyl tert.-butyl ether. There were determined the RON and MON. These values are given in Appendix Table I.

EXAMPLE 12

Methyl tert.-butyl ether was added to the boiling fraction of Example 2 to produce a fuel which contained 30.0 percent by volume methyl tert.-butyl ether and there were determined the RON and MON. These values are given in Appendix Table I.

EXAMPLE 13

There was produced a mixture composed of one part by volume of methyl formate and one part by volume of methyl tert.-butyl ether and this mixture was added to the boiling fraction of Example 2 to produce a fuel containing 10.0 percent by volume of this mixture of methyl formate and methyl tert.-butyl ether. There were determined the RON and MON. These values are given in Appendix Table I.

EXAMPLE 14

There was produced a mixture analogous to Example 13 which was added to the boiling fraction of Example 2 to produce a fuel, but with the fuel containing 20.0 percent by volume of the mixture composed of methyl formate and methyl tert.-butyl ether. There were determined the RON and MON. These values are given in Appendix Table I.

EXAMPLE 15

There was produced a mixture composed of the same parts of methyl formate, methyl alcohol and methyl tert.-butyl ether and this mixture was added to the boiling fraction of Example 2, so that there was obtained a fuel containing the mixture in the amount of 15.0 percent by volume of the fuel. There were determined the RON and MON. These values are given in Appendix Table I.

EXAMPLE 16

There was produced a fuel according to Example 15, and 30.0 percent by volume of the fuel consisted of the mixture of methyl formate, methyl alcohol and methyl tert.-butyl ether. There were determined the RON and MON. These values are given in Appendix Table I.

EXAMPLE 17

EUROSUPER Gasoline

A boiling fraction of 30° C. to 185° C. of a petroleum base stock had a density 0.745 g/cm$^3$. After storage of the mixture at −22° C. turbidity occurred after 5 hours since the water or moisture content of 200 ppm at this temperature no longer could be kept in solution. After 3 days storage at room temperature there was observed sedimentation in the gasoline.

Using the same boiling fraction there was added methyl formate to produce a fuel, the methyl formate being present in the fuel in an amount of 2.0 percent by volume of the fuel, and turbidity occurred only after 5 hours storage at −62° C. After 3 days of storage at room temperature there did not occur any sedimentation.

EXAMPLE 18

Of the boiling fraction of Example 17, without additive, there were determined the RON and MON. These values are given in Appendix Table II.

EXAMPLE 19

Methyl formate was added to the boiling fraction of Example 18 to produce a fuel which contained 5.0 percent by volume methyl formate and there were determined the RON and MON. These values are given in Appendix Table II.

EXAMPLE 20

Methyl formate was added to the boiling fraction of Example 18 to produce a fuel which contained 10.0 percent by volume methyl formate. There were determined the RON and MON. These values are given in Appendix Table II.

EXAMPLE 21

Methyl formate was added to the boiling fraction of Example 18 to produce a fuel which contained 20.0 percent by volume methyl formate. There were determined the RON and MON. These values are given in Appendix Table II.

EXAMPLE 22

Methyl formate was added to the boiling fraction of Example 18 to produce a fuel which contained 30.0 percent by volume methyl formate. There were determined the RON and MON. These values are given in Appendix Table II.

EXAMPLE 23

Methyl formate was added to the boiling fraction of Example 18 to produce a fuel which contained 40.0 percent by volume methyl formate. There were determined the RON and MON. These values are given in Appendix Table II.

EXAMPLE 24

Methyl formate was added to the boiling fraction of Example 18 to produce a fuel which contained 50.0 percent by volume methyl formate. There were determined the RON and MON. These values are given in Appendix Table II.

EXAMPLE 25

There were determined the RON and MON of pure methyl formate. These values are given in Appendix Table II.

EXAMPLE 26

Methyl tert.-butyl ether was added to the boiling fraction of Example 18 to produce a fuel which contained 10.0 percent by volume methyl tert.-butyl ether. There were determined the RON and MON. These values are given in Appendix Table II.

EXAMPLE 27

Methyl tert.-butyl ether was added to the boiling fraction of Example 18 to produce a fuel which contained 20.0 percent by volume methyl tert.-butyl ether. There were determined the RON and MON. These values are given in Appendix Table II.

EXAMPLE 28

Methyl tert.-butyl ether was added to the boiling fraction of Example 18 to produce a fuel which contained 30.0 percent by volume methyl tert.-butyl ether and there were determined the RON and MON. These values are given in Appendix Table II.

EXAMPLE 29

There was produced a mixture composed of one part by volume of methyl formate and one part by volume of methyl tert.-butyl ether and this mixture was mixed with the boiling fraction of Example 18 to produce a fuel which contained 10.0 percent by volume of this mixture of methyl formate and methyl tert.-butyl ether. There were determined the RON and MON. These values are given in Appendix Table II.

EXAMPLE 30

There was produced a mixture analogous to Example 29 which was added to the boiling fraction of Example 18 to produce a fuel, but with the fuel containing 20.0 percent by volume of the mixture composed of methyl formate and methyl tert.-butyl ether. There were determined the RON and MON. These values are given in Appendix Table II.

EXAMPLE 31

There was produced a mixture composed of the same parts of methyl formate, methyl alcohol and methyl tert.-butyl ether and this mixture was added to the boiling fraction of Example 18, so that there was obtained a fuel containing the mixture in the amount of 15.0 percent by volume of the fuel. There were determined the RON and MON. These values are given in Appendix Table II.

EXAMPLE 32

There was produced a fuel according to Example 31, and 30.0 percent by volume of the fuel consisted of the mixture of methyl formate, methyl alcohol and methyl tert.-butyl ether. There were determined the RON and MON. These values are given in Appendix Table II.

While there have been described present preferred embodiments of the invention, it is distinctly to be understood the invention is not limited thereto, but may be otherwise variously embodied and practiced within the scope of the following claims.

Appendix Table I

| Regular Gasoline | RON | MON |
|---|---|---|
| Example 2 | 90.3 | 81.6 |
| Example 3 | 91.1 | 82.3 |
| Example 4 | 91.8 | 83.0 |
| Example 5 | 93.1 | 84.2 |
| Example 6 | 94.2 | 85.1 |
| Example 7 | 95.2 | 86.1 |
| Example 8 | 96.1 | 87.0 |
| Example 9 | 115.0 | 114.8 |
| Example 10 | 91.9 | 82.4 |
| Example 11 | 93.1 | 84.0 |
| Example 12 | 94.3 | 84.8 |
| Example 13 | 82.0 | 83.3 |
| Example 14 | 94.5 | 84.9 |
| Example 15 | 92.1 | 83.6 |
| Example 16 | 94.4 | 85.0 |

Appendix Table II

| EUROSUPER Gasoline | RON | MON |
|---|---|---|
| Example 18 | 96.0 | 84.5 |
| Example 19 | 96.6 | 85.1 |
| Example 20 | 97.1 | 85.6 |
| Example 21 | 98.1 | 86.9 |
| Example 22 | 99.0 | 88.1 |
| Example 23 | 99.9 | 89.0 |
| Example 24 | 101.0 | 89.9 |
| Example 25 | 115.0 | 114.8 |
| Example 26 | 97.0 | 85.9 |
| Example 27 | 98.2 | 86.2 |
| Example 28 | 99.1 | 87.7 |
| Example 29 | 98.0 | 86.2 |
| Example 30 | 98.7 | 86.7 |
| Example 31 | 98.0 | 86.6 |
| Example 32 | 99.3 | 87.9 |

What is claimed is:

1. A fuel for internal combustion engines employing electrical fuel ignition, comprising:

a boiling fraction of 30° C. to 200° C. containing hydrocarbons selected from the group consisting of paraffinic, olefinic and aromatic hydrocarbons and mixtures thereof, and which is free of manganese, lead and iron; and methyl formate in an amount in the range of 3.5 percent by volume to 10.0 percent by volume of the fuel.

2. The fuel for internal combustion engines according to claim 1, further comprising:

methyl tert.-butyl ether.

3. The fuel for internal combustion engines according to claim 2, wherein said methyl formate and methyl tert.-butyl ether are present in essentially the same volumetric amounts.

4. The fuel for internal combustion engines according to claim 2, wherein said fuel contains a mixture of methyl formate and methyl tert.-butyl ether in an amount in the range of 10.0 percent by volume to 60.0 percent by volume of the fuel.

5. The fuel for internal combustion engines according to claim 2, wherein said fuel contains a mixture of methyl formate and methyl tert.-butyl ether in an amount in the range of 30.0 percent by volume to 50 percent by volume of the fuel.

6. The fuel for internal combustion engines according to claim 2, further comprising at least one alcohol.

7. The fuel for internal combustion engines according to claim 6, wherein said alcohol is selected from the group consisting of methyl alcohol, ethyl alcohol and mixtures thereof.

8. The fuel for internal combustion engines according to claim 1, further comprising:

at least one alcohol.

9. The fuel for internal combustion engines according to claim 8, wherein said alcohol is selected from the group consisting of methyl alcohol, ethyl alcohol and mixtures thereof.

10. The fuel for internal combustion engines according to claim 1, further comprising:

methyl tert.-butyl ether and methyl alcohol.

11. The fuel for internal combustion engines according to claim 10, wherein said fuel contains a mixture of methyl formate, methyl tert.-butyl ether and methyl alcohol in an amount in the range of 10.0 percent by volume to 60.0 percent by volume of the fuel.

12. The fuel for internal combustion engines according to claim 11, wherein essentially the same volumetric amounts of methyl formate, methyl tert.-butyl ether and methyl alcohol are present in the mixture.

13. The fuel for internal combustion engines according to claim 10, wherein said fuel contains a mixture of methyl formate, methyl tert.-butyl ether and methyl alcohol in an amount in the range of 30.0 percent by volume to 50.0 percent by volume of the fuel.

14. The fuel for internal combustion engines according to claim 13, wherein essentially the same volumetric amounts of methyl formate, methyl tert.-butyl ether and methyl alcohol are present in the mixture.

15. The fuel for internal combustion engines according to claim 1, wherein said fuel contains a boiling fraction of 30° C. to 180° C. containing hydrocarbons selected from the group consisting of paraffinic, olefinic, and aromatic hydrocarbons and mixtures thereof, and which is free of manganese, lead and iron.

16. The fuel for internal combustion engines according to claim 1 wherein said fuel exhibits an increased octane number when said fuel is used in conjunction with an internal combustion engine employing a carburetor.

17. The fuel for internal combustion engines according to claim 1 wherein said fuel exhibits an increased octance number when said fuel is used in conjunction with an internal combustion engine employing a fuel injection system.

18. A method of increasing the octane number of a fuel for internal combustion engines employing electrical fuel ignition, the fuel comprising a boiling fraction of 30° C. to 200° C. containing hydrocarbons selected from the group consisting of paraffinic, olefinic, and aromatic hydrocarbons and mixtures thereof, and which is free of manganese, lead and iron, comprising:

adding methyl formate to said fuel in an amount in the range of 3.5 percent by volume to 10.0 percent by volume based upon the total fuel solution.

19. A method according to claim 18, wherein said fuel contains a boiling fraction of 30° C. to 180° C. containing hydrocarbons selected from the group consisting of paraffinic, olefinic, and aromatic hydrocarbons and mixtures thereof, and which is free of manganese, lead and iron.

20. A method according to claim 18, wherein said fuel is used in conjunction with an internal combustion engine working with electrical fuel ignition employing a carburetor.

21. A method according to claim 18, wherein said fuel is used in conjunction with an internal combustion engine working with electrical fuel ignition employing a fuel injection system.

22. A method of claim 18 wherein said octane number is the motor or engine octane number.

* * * * *